US007007679B2

(12) United States Patent
Okabe et al.

(10) Patent No.: US 7,007,679 B2
(45) Date of Patent: Mar. 7, 2006

(54) FUEL FEED APPARATUS HAVING SUB-TANK AND JET NOZZLE

(75) Inventors: Kenji Okabe, Obu (JP); Kenichi Nishizaki, Okazaki (JP); Fumio Kaneoka, Okazaki (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 11/065,282

(22) Filed: Feb. 25, 2005

(65) Prior Publication Data

US 2005/0189020 A1 Sep. 1, 2005

(30) Foreign Application Priority Data

Feb. 26, 2004 (JP) ..... 2004-050729

(51) Int. Cl.
*F02M 37/04* (2006.01)

(52) U.S. Cl. ..... 123/509; 123/514

(58) Field of Classification Search ..... 123/509, 123/514, 510, 456; 417/198, 151, 194, 79, 417/76, 77; 137/574, 571
See application file for complete search history.

(56) References Cited

U.S. PATENT DOCUMENTS 4,842,006 A * 6/1989 Scheurenbrand et al. ... 137/202
6,269,800 B1 * 8/2001 Fischerkeller et al. ..... 123/514
6,273,131 B1 * 8/2001 Kleppner ..... 137/565.22
6,425,378 B1 * 7/2002 Frank ..... 123/514
6,520,161 B1 * 2/2003 Hazama ..... 123/509
6,840,231 B1 * 1/2005 Suzuki ..... 123/509
6,868,836 B1 * 3/2005 Buehler et al. ..... 123/509
6,880,569 B1 * 4/2005 Kato ..... 137/565.22

FOREIGN PATENT DOCUMENTS

JP 2001-90700 4/2001
JP 2001-132568 5/2001

* cited by examiner

*Primary Examiner*—Carl S. Miller
(74) *Attorney, Agent, or Firm*—Nixon & Vanderhye PC

(57) ABSTRACT

A fuel feed apparatus, which is accommodated in a fuel tank, includes a sub-tank, a jet pump, and a covering member. The sub-tank includes a fuel inlet. The jet pump includes a jet nozzle, through which fuel is jetted to generate negative pressure, so that fuel in the fuel tank is drawn into the sub-tank through the fuel inlet. The covering member covers a gap formed between the jet nozzle and the fuel inlet. The covering member is opened on the bottom side of the gap. The covering member downwardly extends from the upper side to a gap-lower end position. The gap-lower end position is located on the upper side with respect to the center of the jet nozzle by a distance that is equal to or greater than 1 mm, and is equal to or less than 2 mm.

11 Claims, 9 Drawing Sheets

FUEL FEED APPARATUS HAVING SUB-TANK AND JET NOZZLE

CROSS REFERENCE TO RELATED APPLICATIONS

This application is based on and incorporates herein by reference Japanese Patent Application No. 2004-50729 filed on Feb. 26, 2004.

FIELD OF THE INVENTION

The present invention relates to a fuel feed apparatus, in which fuel is fed into a sub-tank using a jet pump.

BACKGROUND OF THE INVENTION

As disclosed in JP-A-2001-90700, a jet pump jets fluid to generate negative pressure, so that the fluid is drawn into a fluid inlet by the negative pressure.

In the structure disclosed in JP-A-2001-90700, a gap is formed between a jet nozzle and the fluid inlet of the sub-tank. The outer circumferential periphery of the gap is entirely opened, so that the opening area of the gap is widened. The jet pump generates negative pressure, so that fluid is drawn through the gap. Thereby, a large amount of fluid can be introduced into the fluid inlet. The structure disclosed in JP-A-2001-90700 may be applied to a fuel feed apparatus that introduces fuel into a sub-tank received in a fuel tank using a jet pump. In this case, a predetermined amount of fuel can be drawn into the sub-tank, so that a predetermined degree of the pump head can be secured in the sub-tank. The pump head is equivalent to the fuel level in the sub-tank.

However, in the structure disclosed in JP-A-2001-90700, the gap formed between the jet nozzle and the fluid inlet (fuel inlet) of the sub-tank is entirely opened at the outer circumferential periphery. Accordingly, when the fuel level decreases in the fuel tank, fuel on the side of the upper surface is drawn into the fuel inlet by negative pressure, and vortex is caused between the fuel surface and the jet nozzle. As a result, air is drawn into the fuel inlet due to vortex, and pumping noise may arise, even when the fuel level is relatively high in the fuel tank.

According to JP-A-2001-132568, the gap formed between the jet nozzle and the fuel inlet of the sub-tank is covered with a covering member on the side of the surface of fuel. Thereby, vortex is restricted from arising between the jet nozzle and the surface of fuel, so that pumping noise is reduced. The covering member is opened on the bottom side thereof, i.e., on the opposite side of the surface of fuel. Thereby, the opening formed in the bottom of the covering member is located in the vicinity of both the jet nozzle and the fuel inlet of the sub-tank, so that fuel can be easily introduced into the sub-tank.

Here, when fuel remaining in the fuel tank decreases, and the fuel level becomes lower than a dead storage level, fuel cannot be fed into the sub-tank by the jet pump. In the structure disclosed in JP-A-2001-132568, pumping noise is reduced, and an amount of fuel introduced into the sub-tank is maintained, however, the dead storage level is not considered.

Here, when fuel remaining in the fuel tank decreases, and the fuel level becomes lower than a pumping noise arising level, pumping noise becomes large. As the covering member extends to the bottom side, the pumping noise arising level is lowered. That is, when the covering member extends to the bottom side, fuel in the fuel tank can be drawn without arising large pumping noise, even when the fuel level is low. On the contrary, as the covering member extends to the bottom side, the area of the opening, through which fuel is drawn, becomes small, and the pump head decreases.

As shown in FIGS. 12, 13, a gap 320 is formed between a fuel inlet pipe 302, through which fuel is introduced from a sub-tank 300, and a jet nozzle 312 of a jet pump 310. The opening 320 is covered with a covering member 314 similarly to the structure in JP-A-2001-132568. When the gap 320, through which furl is drawn, is small, fuel filling the gap 320 may be frozen in a low temperature condition. When the distance between the jet nozzle 312 and the fuel inlet pipe 302 is increased, fuel filling the gap 320 is not apt to be frozen, however, an amount of fuel introduced into the sub-tank 300 decreases. When the opening area of the gap 320 is small, fuel cannot be drawn into the sub-tank 300 by a predetermined amount, and the pump head decreases.

SUMMARY OF THE INVENTION

In view of the foregoing problems, it is an object of the present invention to produce a fuel feed apparatus, in which both the pumping noise arising level and the dead storage level are decreased as long as possible, and the pump head in the sub-tank is increased as long as possible. It is another object of the present invention to produce a fuel feed apparatus, in which fuel filling the gap, which is formed between the jet nozzle and the fuel inlet of the sub-tank, is restricted from being frozen, and the pump head is increased in the sub-tank.

According to the present invention, a fuel feed apparatus a fuel feed apparatus is accommodated in a fuel tank. The fuel feed apparatus includes a sub-tank, a jet pump, and a covering member.

The sub-tank is accommodated in the fuel tank. The sub-tank includes a fuel inlet, through which fuel in the fuel tank is introduced into the sub-tank. The jet pump includes a jet nozzle through which fuel is jetted to generate negative pressure, so that fuel in the fuel tank is drawn into the sub-tank through the fuel inlet. The jet nozzle and the fuel inlet define a gap therebetween. The covering member includes a gap-covering portion, which covers the gap between the jet nozzle and the fuel inlet. The gap-covering portion is opened on the bottom side of the gap.

The gap-covering portion defines a gap-lower end position. The gap-covering portion downwardly extends from the upper side thereof to the gap-lower end position on the lower end side thereof. The gap-lower end position is located on the upper side with respect to the center of the jet nozzle. The gap-lower end position is apart from the center of the jet nozzle by a distance. The distance between the gap-lower end position and the center of the jet nozzle is equal to or greater than 1 mm. The distance between the gap-lower end position and the center of the jet nozzle is equal to or less than 2 mm.

The gap-lower end position is located on the side of the surface of fluid with respect to the center of the jet nozzle. The fuel inlet is formed in a tubular shape. The fuel inlet has a bottom portion that defines a notch on the side of the jet nozzle. The fuel inlet defines the inner space that communicates with the outside of the fuel inlet through the notch.

The fuel inlet, which is in the tubular shape, protrudes from the lateral side of the sub-tank. The covering member includes an inlet-covering portion that covers the outer circumferential periphery of the fuel inlet. The inlet-covering portion is opened on the bottom side of the fuel inlet. The inlet-covering portion defines an inlet-lower end position on the lower end side thereof. The inlet-covering portion extends from the upper side thereof to the inlet-lower end position on the lower end side thereof. The notch of the fuel inlet upwardly extends from the bottom portion of the fuel inlet substantially to the inlet-lower end position of inlet-covering portion. The inlet-lower end position is on the bottom side with respect to the gap-lower end position. The covering member engages with the fuel inlet.

Alternatively, a fuel feed apparatus is accommodated in a fuel tank. The fuel feed apparatus includes a sub-tank, a jet pump, and a covering member.

The sub-tank is accommodated in the fuel tank. The sub-tank includes a fuel inlet in a tubular shape. Fuel in the fuel tank is introduced into the sub-tank through the fuel inlet. The jet pump includes a jet nozzle, through which fuel is jetted to generate negative pressure, so that fuel in the fuel tank is drawn into the sub-tank through the fuel inlet. The jet nozzle and the fuel inlet define a gap therebetween.

The covering member includes a gap-covering portion. The gap-covering portion covers the gap. The covering member is opened on the bottom side of the gap. The fuel inlet has a bottom portion that defines a notch on the side of the jet nozzle. The fuel inlet defines the inner space that communicates with the outside of the fuel inlet through the notch.

The fuel inlet, which is in the tubular shape, protrudes from the lateral side of the sub-tank. The covering member includes an inlet-covering portion that covers the outer circumferential periphery of the fuel inlet. The inlet-covering portion is opened on the bottom side of the fuel inlet. The inlet-covering portion defines an inlet-lower end position on the lower end side thereof. The inlet-covering portion downwardly extends from the upper side thereof to the inlet-lower end position on the lower end side thereof. The notch of the fuel inlet upwardly extends from the bottom portion of the fuel inlet substantially to the inlet-lower end position of inlet-covering portion.

The gap-covering portion of the covering member has the circumferential length in the circumferential direction of the covering member. The circumferential length of the gap-covering portion is larger than the circumferential length of the inlet-covering portion in the circumferential direction of the covering member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
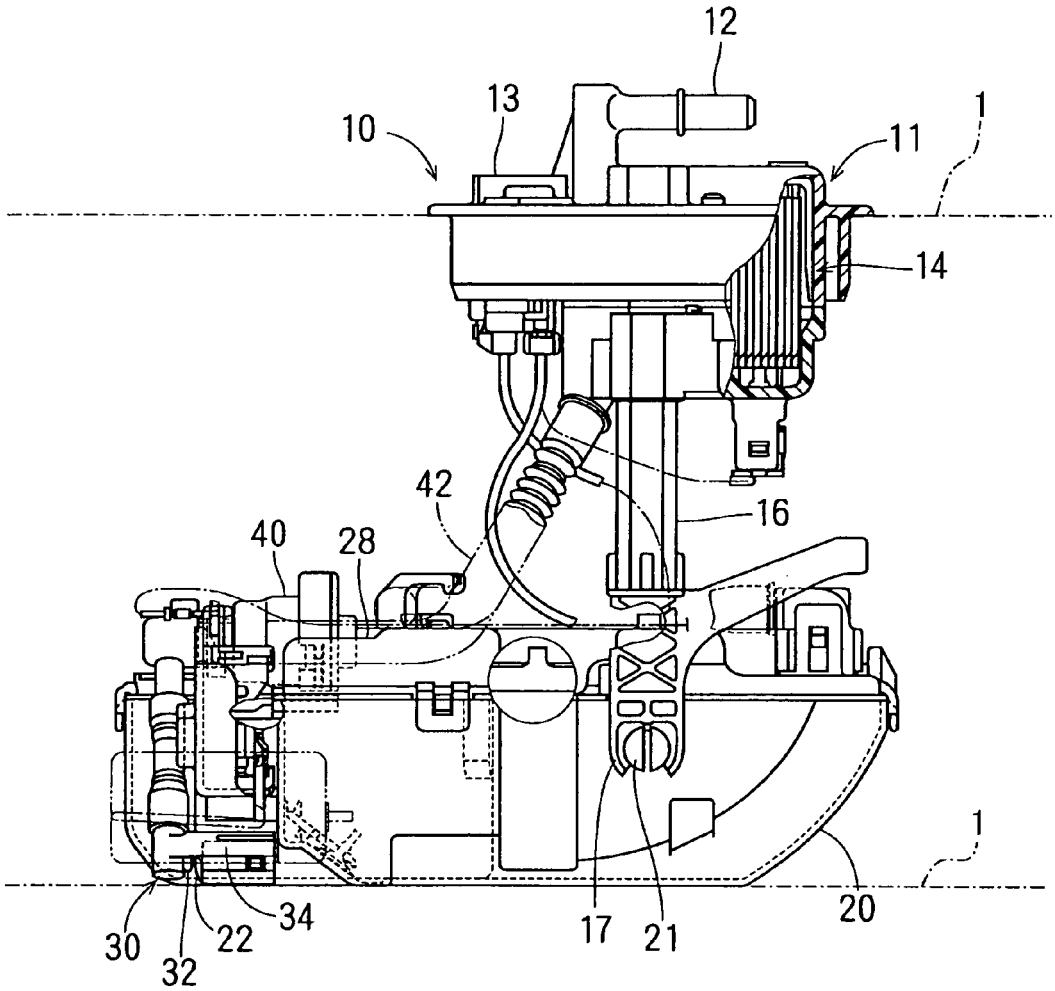
FIG. 1 is a partially cross sectional side view showing a fuel feed apparatus according to a first embodiment of the present invention.

As shown in FIG. 1, A fuel feed apparatus 10 includes a sub-tank 20 that accommodates a fuel pump (not shown). The fuel pump is horizontally mounted. The fuel feed apparatus 10 has a lid member 11 formed of resin. The lid member 11 is mounted to the upper wall of a fuel tank 1. The fuel tank 1 is formed of resin. The fuel feed apparatus 10 excluding the lid member 11 is accommodated in the fuel tank 1. The lid member 11 is provided with a discharge pipe 12, an electric connector 13, a fuel filter 14, and the like. The fuel pump (not shown) pumps fuel in the sub-tank 20 to the outside of the fuel tank 1 through a bellows pipe 42, the fuel filter 14, and the discharge pipe 12. The fuel filter 14 removes a foreign material contained in fuel discharged from the fuel pump. The fuel discharged from the fuel pump is introduced to the discharge pipe 12 through the bellows pipe 42. A sub-tank lid 28 closes an opening formed on the upper side of the sub-tank 20. A pressure regulator 40 is provided to the sub-tank lid 28 to control pressure of fuel discharged from the fuel pump.

The lid member 11 and the sub-tank 20 are connected to each other via a stay 16. The stay 16 has a claw 17 that engages with a stick-shaped engagement portion 21 provided to the sub-tank 20, so that the stay 16 is connected to the sub-tank 20.

The sub-tank 20 is formed of resin. A fuel inlet pipe (fuel inlet) 22 is integrally formed of resin with the bottom of the sub-tank 20. The fuel inlet pipe 22 protrudes from the sub-tank 20 to the lateral side thereof, so that the fuel inlet pipe 22 serves as a fuel inlet port of the sub-tank 20.

Figure 3A:
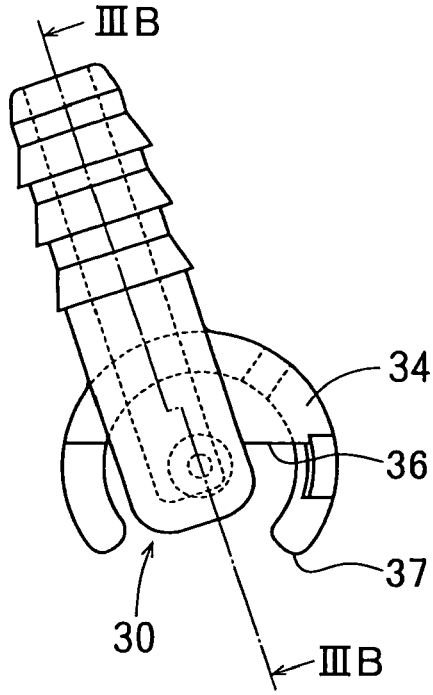
FIG. 3A is side view showing the jet pump from the opposite side of a jet nozzle of the jet pump according to the first embodiment.
Figure 3B:
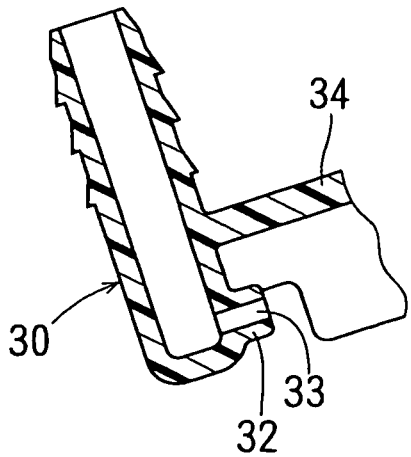
FIG. 3B is a cross-sectional view taken along the line IIIB—IIIB in FIG. 3A.

A jet pump 30 includes a jet nozzle 32 having a nozzle hole 33 (FIG. 3B). The pressure regulator 40 discharges surplus fuel, and the surplus fuel is discharged through the nozzle hole 33 formed in the jet nozzle 32. The surplus fuel is discharged from the jet nozzle 32 into the fuel inlet pipe 22, so that suction pressure is generated around the fuel discharged from the jet nozzle 32. The suction pressure is lower than the atmospheric pressure, and fuel in the fuel tank 1 is drawn into the fuel inlet pipe 22 by the suction pressure. The fuel is fed into the sub-tank 20 through the fuel inlet pipe 22.

Figure 2A:
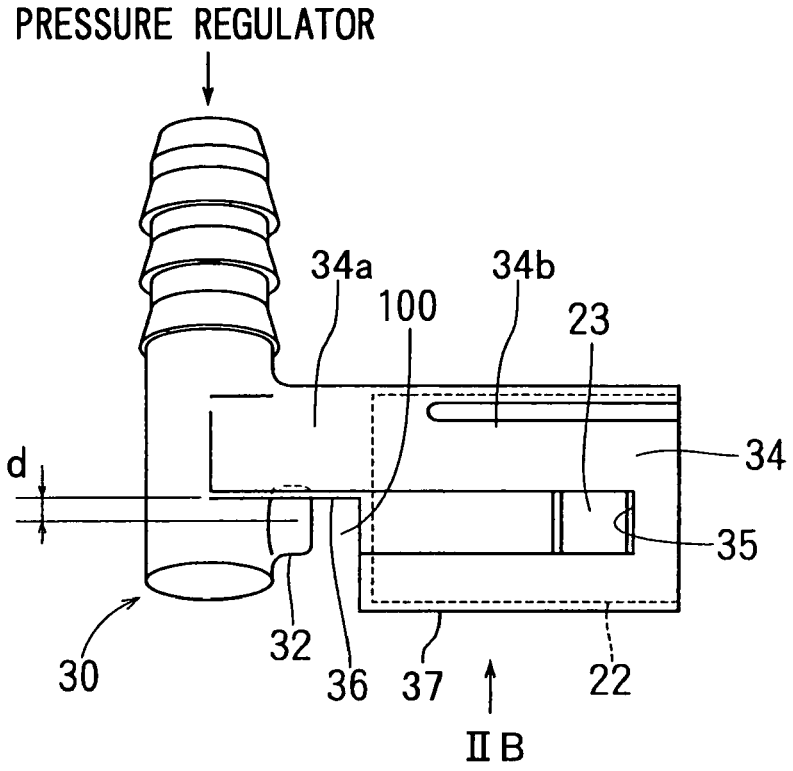
FIG. 2A is side view showing a jet pump, a covering member, and a fuel inlet pipe according to the first embodiment.
Figure 2B:
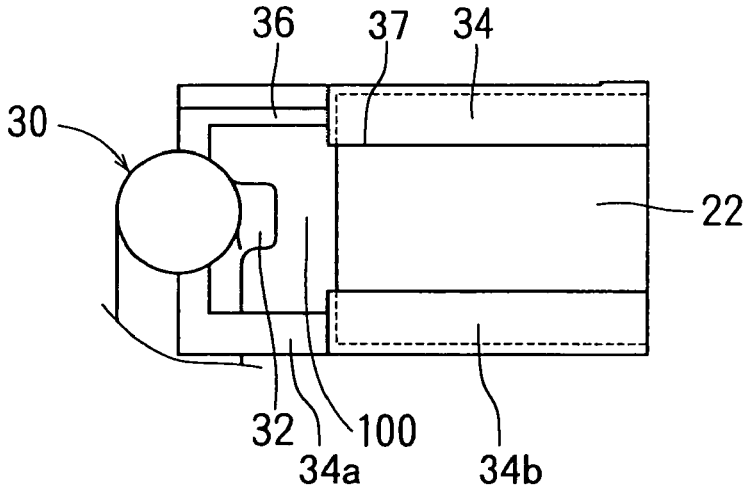
FIG. 2B is a view when being viewed from the arrow IIB in FIG. 2A.

As shown in FIGS. 2A, 2B, a covering member 34 is integrally formed of resin with the jet pump 30. The covering member 34 engages with the outer circumferential periphery of the fuel inlet pipe 22. The covering member 34 covers a gap 100, which is formed between the jet nozzle 32 and the fuel inlet pipe 22. Specifically, the covering member 34 has a gap-covering portion 34*a* that covers the gap 100 formed between the jet nozzle 32 and the fuel inlet pipe 22. The covering member 34 covers the gap 100 on the side of the surface of fuel in the sub-tank 20. The covering member 34 does not cover the lower side of the gap 100 at least partially, so that the lower side of the gap 100 is opened to the inside of the fuel tank 1.

The covering member 34 covers the outer periphery of the fuel inlet pipe 22 excluding the bottom side thereof. Specifically, the covering member 34 has an inlet-covering portion 34*b* that covers the outer periphery of the fuel inlet pipe 22 excluding the bottom side thereof. The bottom side of the outer periphery of the fuel inlet pipe 22 is opened to the inside of the fuel tank 1. That is, the inner space formed in the inlet pipe 22 is communicated the outside of the inlet pipe 22, i.e., the inside of the fuel tank 1. The sidewall of the covering member 34, which covers the outer periphery of the fuel inlet pipe 22, defines a window 35. The fuel inlet pipe 22 has a protrusion 23 that engages with the window 35 of the sidewall of the covering member 34, so that the fuel inlet pipe 22 connects to the covering member 34.

As shown in FIGS. 2A, 2B, 3A, the covering member 34, which covers the gap 100, defines a first lower end position (gap-lower end position) 36. The covering member 34, which covers the outer periphery of the fuel inlet pipe 22, defines a second lower end position (inlet-lower end position) 37. The second lower end position 37 is located on the bottom side with respect to the first lower end position 36, as shown in FIG. 3A. That is, the portion of the covering member 34, which covers the gap 100, is cut and opened, i.e., is notched to the side of the surface of fuel with respect to the portion of the covering member 34, which covers the fuel inlet pipe 22. The first lower end position 36 of the covering member 34 is located on the upper side, i.e., on the surface side of fuel with respect to the center of the jet nozzle 32 by the distance d. The distance d is equal to or greater than 1 mm, and is equal to or less than 2 mm.

Figure 4:
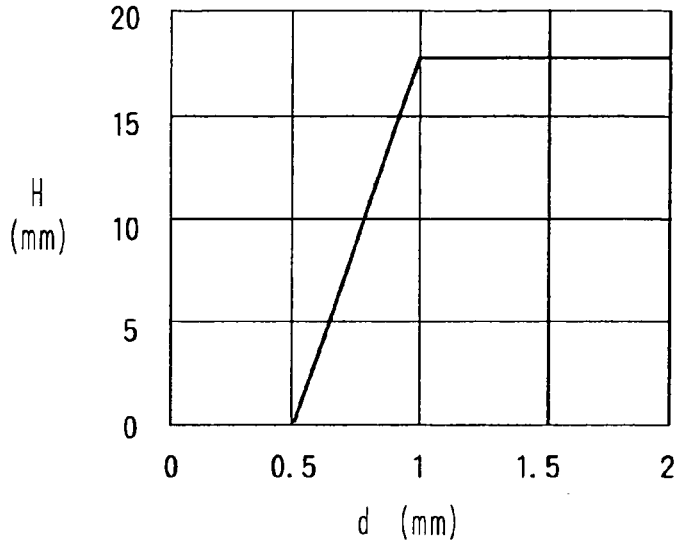
FIG. 4 is a graph showing a relationship between the distance d, which is between the center of the jet pump and the lower end of the covering member, and the pump head H in a sub-tank.
Figure 5:
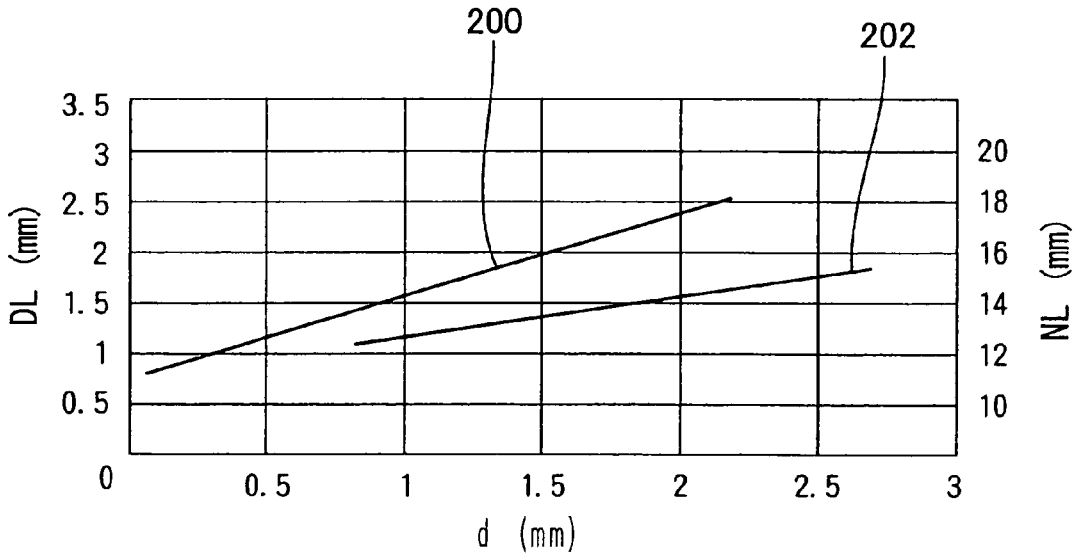
FIG. 5 is a graph showing a relationship among the distance d, the dead storage level DL and the pumping noise arising level NL.

Next, relationship among the distance d in the vertical direction, the dead storage level DL, and the pumping noise arising level NL is described in reference to FIGS. 4, 5. FIGS. 4, 5 show experimental results in a condition, in which the diameter D of the nozzle hole 33 of the jet nozzle 32 is set at 1.45 mm and 1.55 mm.

As the diameter D of the nozzle hole 33 of the jet nozzle 32 increases, the pumping capacity of the jet nozzle 32 for pumping fuel into the sub-tank 20 decreases. That is, the pumping capacity of the nozzle hole 33 in the diameter D of 1.55 mm is lower than the pumping capacity of the nozzle hole 33 in the diameter D of 1.45 mm. Therefore, as the diameter D of the nozzle hole 33 increases, the pump head H of the jet nozzle 32 and the dead storage level DL decrease. On the contrary, as the diameter D of the nozzle hole 33 decreases, the pumping noise arising level NL increases.

In the experimental conditions in FIGS. 4, 5, the diameter D of the nozzle hole 33 is chosen from 1.45 mm and 1.55 mm to be in disadvantageous experimental conditions. That is, the diameter D of the nozzle hole 33 is chosen from 1.45 mm and 1.55 mm for each the experimental condition, such that worse experimental results are to be obtained through the experiments. Specifically, the diameter D of the nozzle hole 33 is set at 1.55 mm in the experimental conditions of both the relationship between the distance d and the pump head H shown in FIG. 4 and the relationship 200 between the distance d and the dead storage level DL shown in FIG. 5. By contrast, the diameter D of the nozzle hole 33 is set at 1.45 mm in the experimental conditions of the relationship 202 between the distance d and the pumping noise arising level NL.

As shown in FIG. 4, as the portion of the covering member 34, which covers the gap 100, extends to the bottom side, and the first lower end position 36 of the covering member 34 is lowered to the bottom side, the distance d (FIG. 2A) decreases, and the opening area of the gap 100 decreases. Accordingly, the pump head H in the sub-tank 20 decreases. On the contrary, as the first lower end position 36 of the covering member 34 is raised to the surface side of fuel, the distance d increases, and the opening area of the gap 100 increases. In this situation, the pump head H in the sub-tank 20 increases until the distance d becomes substantially 1 mm, and when the distance d becomes equal to or greater than 1 mm, the pump head H becomes substantially constant.

According to the relationship 200 shown in FIG. 5, as the distance d increases, the dead storage level DL increases. The dead storage level DL is preferably equal to or less than 2.5 mm. When the distance d is equal to or less than 2 mm, the dead storage level DL is in the preferable range, in which the dead storage level DL is equal to or less than 2.5 mm.

According to the relationship 202 shown in FIG. 5, as the distance d increases, the pumping noise arising level NL increases. The pumping noise arising level NL is preferably equal to or less than 18 mm. The preferable pumping noise arising level NL is a fuel level, which is slightly lower than the empty level, in which a fuel lamp is lit on a front panel of a vehicle, for example. When the distance d is equal to or less than 2 mm, the pumping noise arising level NL is equal to or less than 18 mm, even when the diameter D of the nozzle hole 33 is set at 1.45 mm and the pumping noise arising level NL increases compared with a case in which the diameter D is set at 1.55 mm.

Therefore, the distance d is set within the range, in which $1\ \text{mm} \leqq d \leqq 2\ \text{mm}$, so that the pump head H can be increased as long as possible, and both the dead storage level DL and the pumping noise arising level NL can be decreased as long as possible, according to FIGS. 4, 5.

The portion of the covering member 34, which covers the gap 100, is notched to the side of the surface of fuel with respect to the portion of the covering member 34, which covers the fuel inlet pipe 22. Therefore, a portion of the covering member 34 that covers the outer circumferential periphery of the fuel inlet pipe 22 is longer than a portion of the covering member 34 that covers the gap 100 in the circumferential direction. Therefore, the covering member 34 can be easily engaged with the fuel inlet pipe 22 via the portion of the covering member 34 that covers the outer circumferential periphery of the fuel inlet pipe 22.

(Second Embodiment)

Figure 6:
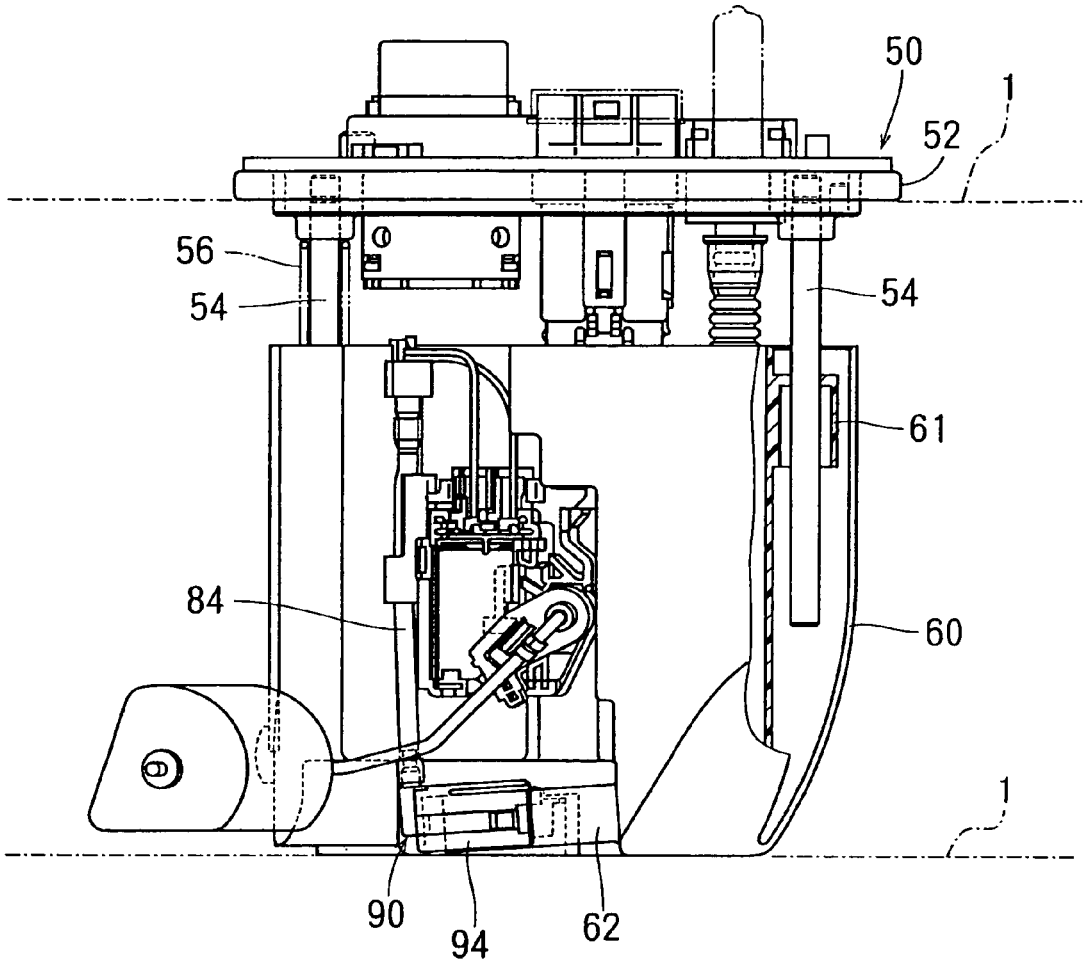
FIG. 6 is a partially cross sectional side view showing a fuel feed apparatus according to a second embodiment of the present invention.
Figure 7:
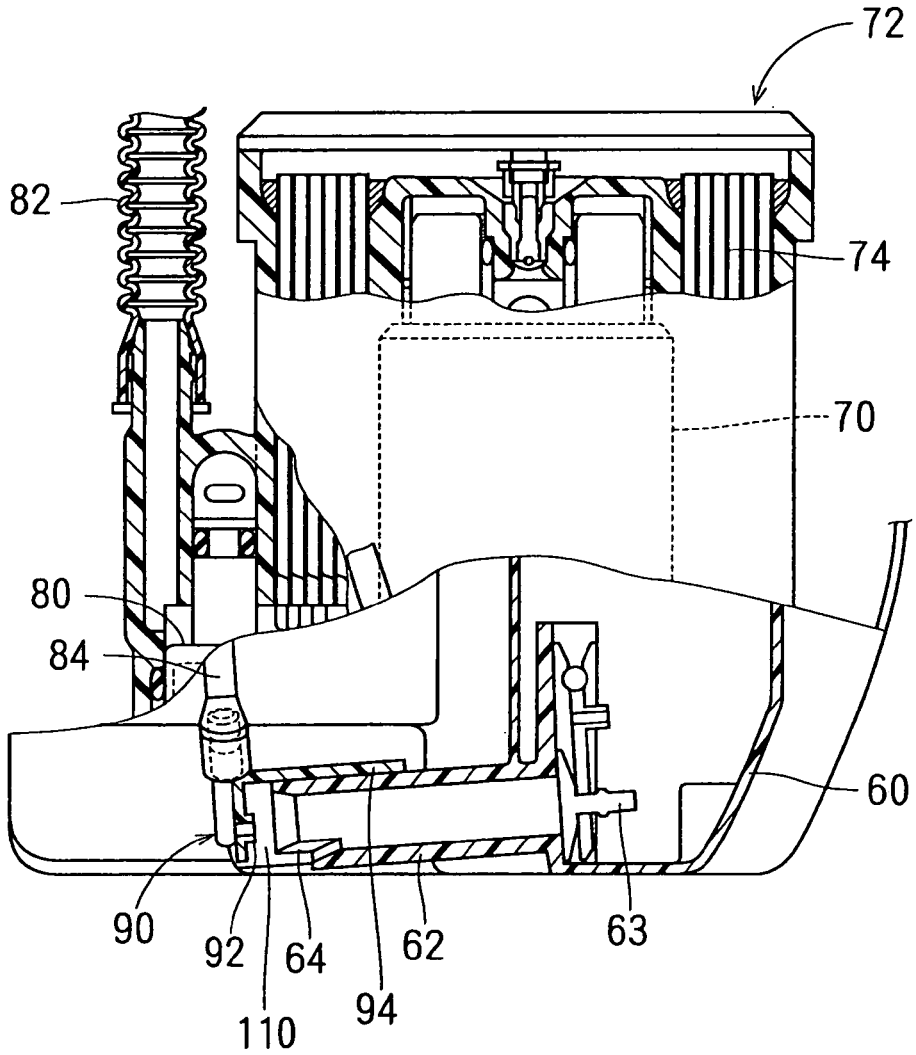
FIG. 7 is a partially cross sectional side view showing a jet pump and a fuel inlet pipe of the fuel feed apparatus according to the second embodiment.

As shown in FIGS. 6, 7, a fuel feed apparatus 50 includes a sub-tank 60 that accommodates a fuel pump 70 (FIG. 7). The fuel pump 70 is vertically mounted in the sub-tank 60 in this embodiment.

As shown in FIG. 6, a lid member 52 closes an opening formed in the fuel tank 1. The lid member 52 and the sub-tank 60 are connected to each other via shafts 54 formed of metal. Each shaft 54 has one end that is press-inserted into the lid member 52. The other end the shaft 54 is inserted into an insertion portion 61 of the sub-tank 60. A spring 56 is arranged on the circumferentially outer side of one of the shaft 54. The spring 56 has one end that is hooked to the lid member 52. The other end of the spring 56 is hooked to the insertion portion 61 of the sub-tank 60. Thereby, the spring 56 urges both the lid member 52 and the sub-tank 60 such that the lid member 52 and the sub-tank 60 are apart from each other.

As shown in FIG. 7, the fuel pump 70 is surrounded by a fuel filter 72 on the outer circumferential periphery thereof. The fuel filter 72 includes a filter element 74 that removes foreign materials included in fuel discharged from the fuel pump 70. The bottom of the sub-tank 60 includes a fuel inlet pipe (fuel inlet) 62 that protrudes from the sub-tank 60 to the lateral side thereof. The fuel inlet pipe 62 is integrally formed of resin with the sub-tank 60, so that the fuel inlet pipe 62 serves as a fuel inlet port of the sub-tank 60. The fuel inlet pipe 62 has a fuel outlet port on the side of the sub-tank 60. A valve member 63 is provided to the fuel outlet port of the fuel inlet pipe 62 for restricting fuel from flowing out of the sub-tank 60 into the fuel tank 1.

Fuel is removed of foreign materials through the fuel filter, and the fuel is controlled in pressure by a pressure regulator 80 provided to the lateral side of the fuel filter 82. The fuel controlled in pressure by the pressure regulator 80 is fed to the outside of the fuel tank 1 through a bellows pipe 82. Fuel is intermediately pressurized in the fuel pump 70, and the fuel is drawn into a jet pump 90 after passing through a vent hole (not shown) formed in the fuel pump 70 and a vinyl pipe 84. The jet pump 90 jets the fuel, which is drawn through the vinyl pipe 84, from a jet nozzle 92 thereof.

Figure 9:
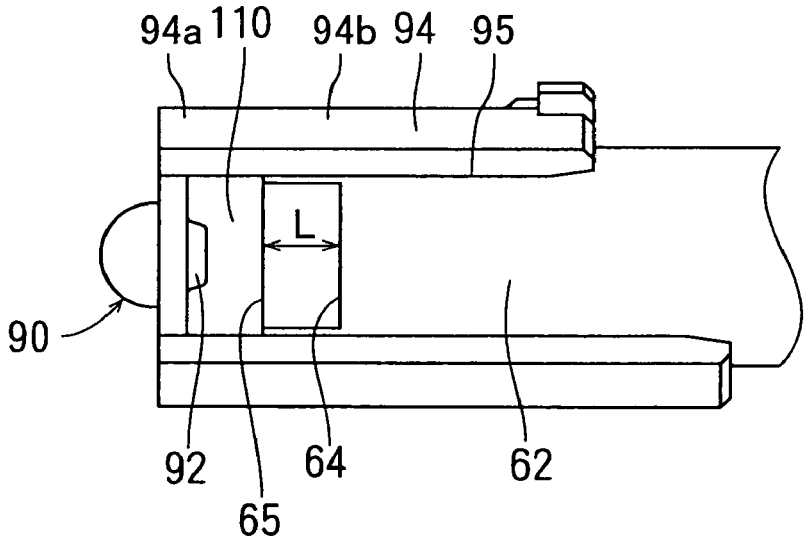
FIG. 9 is a bottom view showing a covering portion that partially covers the fuel inlet pipe according to the second embodiment.

As shown in FIG. 9, the jet pump 90 is integrally formed of resin with a covering member 94. The covering member 94 engages with the outer periphery of the fuel inlet pipe 62. The covering member 94 covers a gap 110 formed between the jet nozzle 92 and the fuel inlet pipe 62 on the surface side of the fuel, i.e., on the upper side thereof. The covering member 94 is opened on the bottom side of the gap 110. The covering member 94 covers the outer circumferential periphery of the fuel inlet pipe 62 excluding the bottom side thereof. The covering member 94 is opened on the bottom side of the fuel inlet pipe 62. The covering member 94 defines a lower end position (second lower portion, inlet-lower portion) 95 on the bottom side thereof. The lower end position 95 of the covering member 94 on the side of the gap 110 is substantially the same as the lower end position 95 on the side of the fuel inlet pipe 62.

Figure 8:
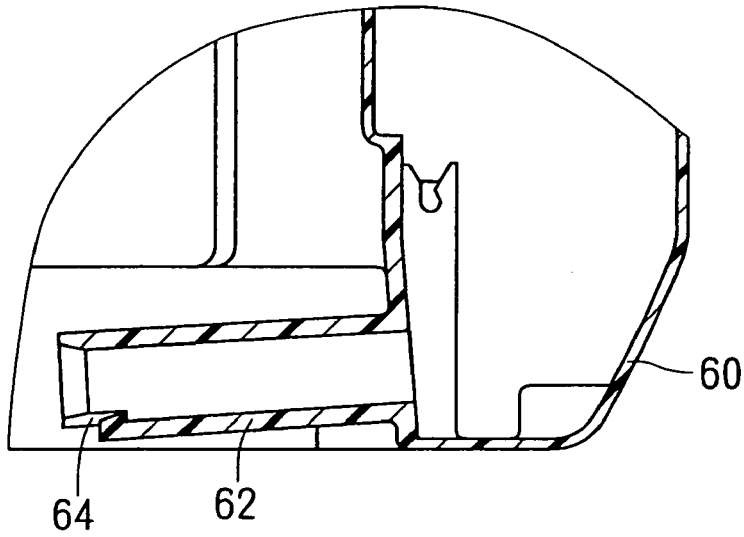
FIG. 8 is a cross sectional side view showing the fuel inlet pipe of a sub-tank of the fuel feed apparatus according to the second embodiment.

As shown in FIGS. 8, 9, a notch 64 is formed in the bottom of the fuel inlet pipe 62 on the side of the jet nozzle 92. The notch 64 extends from the bottom side of the fuel inlet pipe 62 to the lower end position 95 of the covering member 94. As shown in FIG. 9, the notch 64 is formed from an inlet end 65 of the fuel inlet pipe 62 on the side of the jet nozzle 92 along the direction, in which fuel is introduced into the sub-tank 60. The notch 64 extends from the inlet end 65 of the jet nozzle 92 by the length L.

Figure 10:
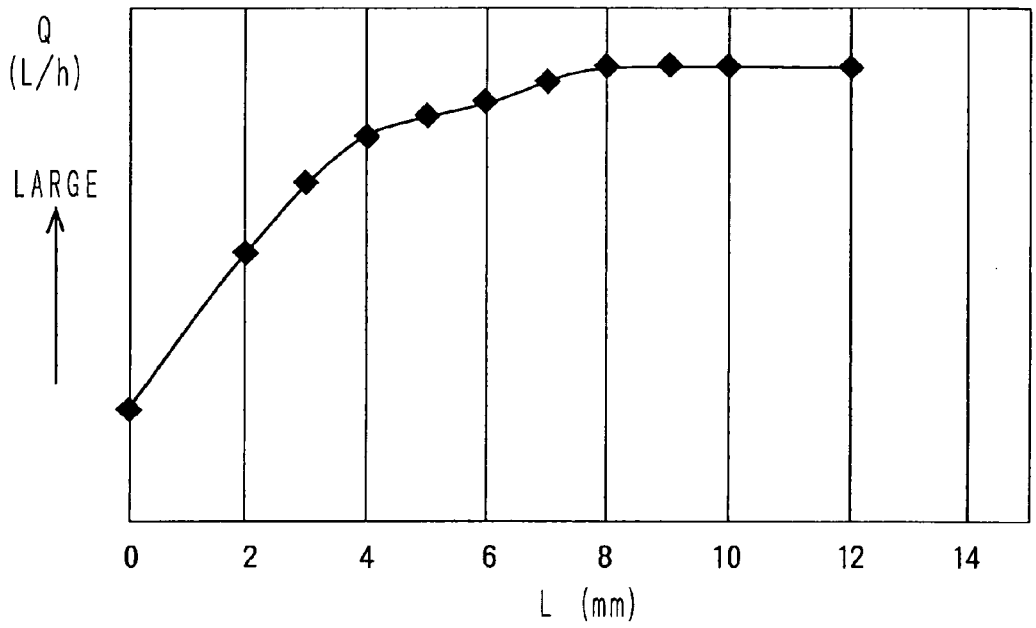
FIG. 10 is a graph showing a relationship between a length N of a notch, which is formed in the bottom of the fuel inlet pipe, and the pumping discharge Q.

As shown in FIG. 10, as the length L of the notch 64 increases, the opening area of the gap 110 increases, and a flow amount Q, by which fuel is drawn into the sub-tank 60, increases. As a result, as the flow amount Q increases, the pump head H increases. Here, when the length L=0, the notch 64 is not formed in the fuel inlet pipe 62.

In this embodiment, the bottom of the fuel inlet pipe 62 on the side of the jet nozzle 92 is notched, so that the opening area of the gap 110 is enlarged. As a result, fuel filling the gap 110 is not apt to be frozen. Furthermore, the bottom of the fuel inlet pipe 62 is notched upwardly to the lower end position 95 of the covering member 94, so that the opening area of the gap 110 formed between the jet nozzle 92 and the fuel inlet pipe 62 of the sub-tank 60 can be further enlarged. Thereby, the flow amount Q can be increased, and the pump head H can be increased.

(Third Embodiment)

Figure 11:
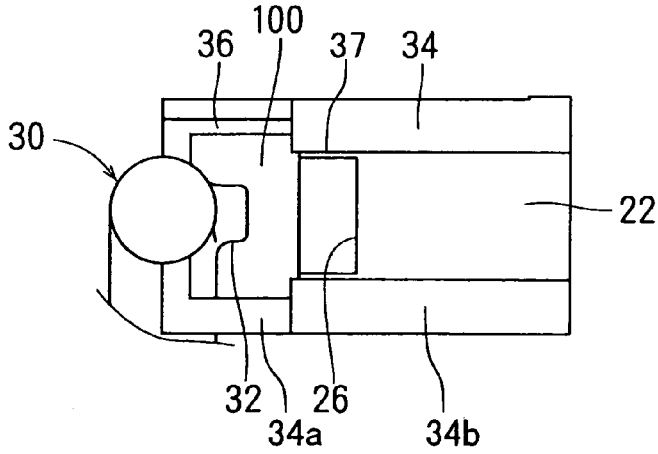
FIG. 11 is a bottom view showing the covering portion that partially covers a fuel inlet pipe according to a third embodiment of the present invention.
Figure 12:
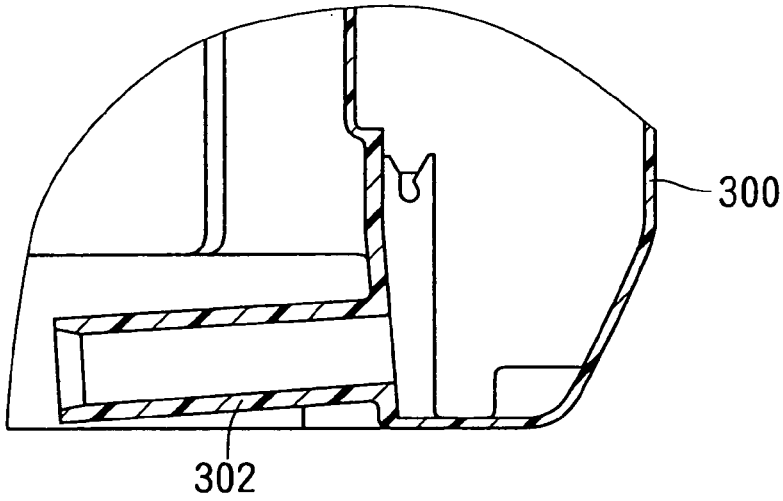
FIG. 12 PRIOR ART
FIG. 12 is a cross sectional side view showing a fuel inlet pipe of a sub-tank of a fuel feed apparatus according to a prior art.
Figure 13:
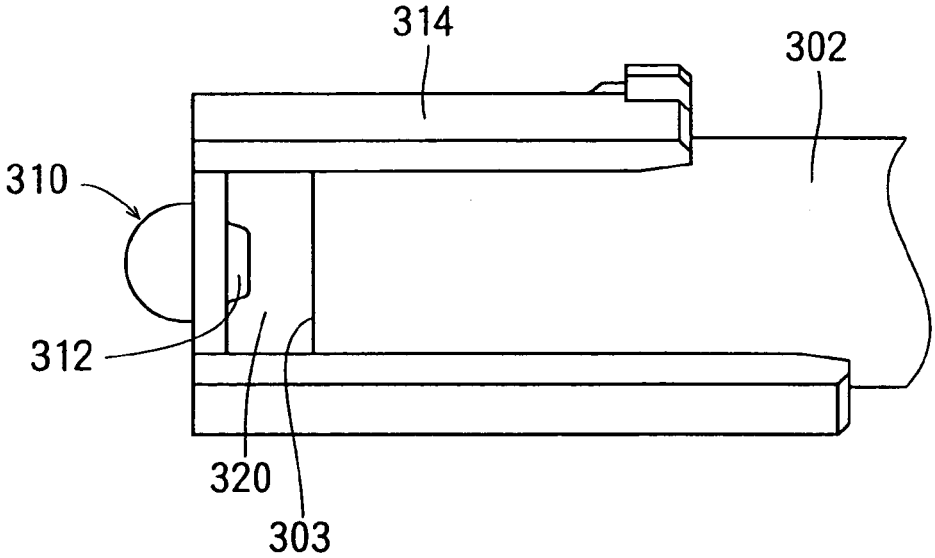
FIG. 13 PRIOR ART
FIG. 13 is a bottom view showing a covering portion that partially covers the fuel inlet pipe according to the prior art.

As shown in FIG. 11, in this embodiment, the fuel inlet pipe 22 has a structure substantially equivalent to the structure of the first embodiment. However, a notch 26 is formed in the bottom of the fuel inlet pipe 22 on the side of the jet nozzle 32, similarly to the second embodiment. As referred to FIG. 2A, the covering member 34 covers the gap 100 on the surface side of fuel, and the first lower end position 36 of the covering member 34 is located on the upper side, i.e., on the surface side of fuel with respect to the center of the jet nozzle 32 by the distance d. The distance d is equal to or greater than 1 mm, and is equal to or less than 2 mm, similarly to the first embodiment.

In the structure of the third embodiment, the pump head H is increased as long as possible, and both the dead storage level DL and the pumping noise arising level NL are decreased as long as possible, similarly to the first embodiment. Besides, in the structure of the third embodiment, fuel filling the gap 100 is not apt to be frozen, similarly to the second embodiment.

(Other Embodiment)

In the first and the third embodiments, as referred to FIG. 2A, the second lower end position 37 of the covering member 34 for the fuel inlet pipe 22 is located on the bottom side with respect to the first lower end position 36 for the gap 100. However, the first and second lower end positions 36, 37 may be substantially the same, as long as the first lower end position 36 is located on the upper side with respect to the center of the jet nozzle 32 by the distance d that is equal to or greater than 1 mm, and is equal to or less than 2 mm.

The covering member may cover only the gap formed between the jet nozzle and the fuel inlet pipe on the surface side of fuel, without covering the outer circumferential periphery of the fuel inlet pipe.

The fuel inlet port of the sub-tank is not limited to the fuel inlet pipe that protrudes from the lateral side of the sub-tank. The sub-tank may have a through hole formed in the sidewall thereof to serve as a fuel inlet port, through which fuel in the fuel tank is introduced into the sub-tank by suction pressure generated by the jet pump.

The jet pump may be formed to be a component separated from the covering member, instead of the structure, in which the jet pump and the covering member are integrally formed of resin.

Various modifications and alternations may be diversely made to the above embodiments without departing from the spirit of the present invention.

What is claimed is:

1. A fuel feed apparatus accommodated in a fuel tank, the fuel feed apparatus comprising:

a sub-tank that is accommodated in the fuel tank, wherein the sub-tank includes a fuel inlet through which fuel in the fuel tank is introduced into the sub-tank;

a jet pump that includes a jet nozzle through which fuel is jetted to generate negative pressure, so that fuel in the fuel tank is drawn into the sub-tank through the fuel inlet, wherein the jet nozzle and the fuel inlet define a gap therebetween; and a covering member that includes a gap-covering portion, which covers the gap between the jet nozzle and the fuel inlet, wherein the gap-covering portion is opened on a bottom side of the gap, wherein the gap-covering portion defines a gap-lower end position, wherein the gap-covering portion downwardly extends from an upper end thereof to the gap-lower end position, the gap-lower end position is located on an upper side with respect to a center of the jet nozzle, the gap-lower end position is apart from the center of the jet nozzle by a distance, the distance between the gap-lower end position and the center of the jet nozzle is equal to or greater than 1 mm, and the distance between the gap-lower end position and the center of the jet nozzle is equal to or less than 2 mm.

2. The fuel feed apparatus according to claim 1, wherein the gap-lower end position is located on a side of a surface of fluid with respect to the center of the jet nozzle.

3. The fuel feed apparatus according to claim 1, wherein the fuel inlet is formed in a tubular shape, and the fuel inlet has a bottom portion that defines a notch on a side of the jet nozzle.

4. The fuel feed apparatus according to claim 3, wherein the fuel inlet defines an inner space that communicates with an outside of the fuel inlet through the notch.

5. The fuel feed apparatus according to claim 3, wherein the fuel inlet protrudes from a lateral side of the sub-tank, the covering member includes an inlet-covering portion that covers an outer circumferential periphery of the fuel inlet, the inlet-covering portion is opened on a bottom side of the fuel inlet, the inlet-covering portion defines an inlet-lower end position, wherein the inlet-covering portion extends from an upper end thereof to the inlet-lower end position, and the notch of the fuel inlet upwardly extends from a bottom end thereof substantially to the inlet-lower end position of inlet-covering portion.

6. The fuel feed apparatus according to claim 5, wherein the inlet-lower end position is on a bottom side with respect to the gap-lower end position, and the covering member engages with the fuel inlet.

7. The fuel feed apparatus according to claim 5, wherein the gap-covering portion of the covering member has a circumferential length in a circumferential direction of the covering member, and the circumferential length of the gap-covering portion is larger than a circumferential length of the inlet-covering portion in the circumferential direction of the covering member.

8. A fuel feed apparatus accommodated in a fuel tank, the fuel feed apparatus comprising:

a sub-tank that is accommodated in the fuel tank, wherein the sub-tank includes a fuel inlet in a tubular shape, wherein fuel in the fuel tank is introduced into the sub-tank through the fuel inlet;

a jet pump that includes a jet nozzle through which fuel is jetted to generate negative pressure, so that fuel in the fuel tank is drawn into the sub-tank through the fuel inlet, wherein the jet nozzle and the fuel inlet define a gap therebetween; and a covering member that includes a gap-covering portion, the gap-covering portion covering the gap, wherein the covering member is opened on a bottom side of the gap, and wherein the fuel inlet has a bottom portion that defines a notch on a side of the jet nozzle, the fuel inlet protrudes from a lateral side of the sub-tank, the covering member includes an inlet-covering portion that covers an outer circumferential periphery of the fuel inlet, the inlet-covering portion is opened on a bottom side of the fuel inlet, the inlet-covering portion defines an inlet-lower end position, the inlet-covering portion downwardly extends from an upper end thereof to the inlet-lower end position, and the notch of the fuel inlet upwardly extends from a bottom end thereof substantially to the inlet-lower end position of inlet-covering portion.

9. The fuel feed apparatus according to claim 8, wherein the fuel inlet defines an inner space that communicates with an outside of the fuel inlet through the notch.

10. The fuel feed apparatus according to claim 8, wherein the inlet-lower end position is on a bottom side with respect to the gap-lower end position, and the covering member engages with the fuel inlet.

11. The fuel feed apparatus according to claim 8, wherein the gap-covering portion of the covering member has a circumferential length in a circumferential direction of the covering member, and the circumferential length of the gap-covering portion is larger than a circumferential length of the inlet-covering portion in the circumferential direction of the covering member.

* * * * *